US011525187B2

(12) United States Patent
Tatsumi et al.

(10) Patent No.: US 11,525,187 B2
(45) Date of Patent: Dec. 13, 2022

(54) HIGH-CONCENTRATION TIN SULFONATE AQUEOUS SOLUTION AND METHOD FOR PRODUCING SAME

(71) Applicant: MITSUBISHI MATERIALS CORPORATION, Tokyo (JP)

(72) Inventors: Koji Tatsumi, Sanda (JP); Kyohei Mineo, Sanda (JP); Hirotaka Hirano, Sanda (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 17/433,909

(22) PCT Filed: Feb. 21, 2020

(86) PCT No.: PCT/JP2020/006991
§ 371 (c)(1),
(2) Date: Aug. 25, 2021

(87) PCT Pub. No.: WO2020/175352
PCT Pub. Date: Sep. 3, 2020

(65) Prior Publication Data

US 2022/0042196 A1 Feb. 10, 2022

(30) Foreign Application Priority Data

Feb. 28, 2019 (JP) ..... JP2019-035186
Feb. 6, 2020 (JP) ..... JP2020-018835

(51) Int. Cl.

| | |
|---|---|
| ***C25D 3/30*** | (2006.01) |
| ***C25D 3/32*** | (2006.01) |
| ***C01B 17/98*** | (2006.01) |
| ***C25B 1/01*** | (2021.01) |
| ***C25B 15/08*** | (2006.01) |

(52) U.S. Cl.
CPC ..... *C25D 3/30* (2013.01); *C25B 1/01* (2021.01); *C25B 15/08* (2013.01)

(58) Field of Classification Search
CPC .... C25D 3/30; C25D 3/36; C25D 3/32; C01B 17/98
USPC ..... 205/300; 423/517
See application file for complete search history.

(56) References Cited

U.S. PATENT DOCUMENTS 2,585,902 A * 2/1952 Gray ..... C25D 3/32 205/302
2,854,388 A * 9/1958 Safranek ..... C25D 3/58 205/241
8,974,752 B2 3/2015 Grandbois
2003/0150743 A1* 8/2003 Obata ..... C25D 3/32 205/252
2014/0127109 A1 5/2014 Katase et al.
2014/0166492 A1* 6/2014 Shimoyama ..... C25D 3/30 205/82
2017/0009362 A1 1/2017 Werner et al.
2019/0025107 A1* 1/2019 Stahl ..... G01F 15/12
2020/0231461 A1* 7/2020 Takemoto ..... C01G 19/02

FOREIGN PATENT DOCUMENTS

| | | | | |
|---|---|---|---|---|
| CN | 101671838 A | | 3/2010 | |
| CN | 103043711 A | | 4/2013 | |
| CN | 104060308 A | * | 9/2014 | ..... C25D 3/32 |
| CN | 105899714 A | | 8/2016 | |
| CN | 106283103 A | | 1/2017 | |
| JP | H07-41999 A | | 2/1995 | |
| JP | H11-152595 A | | 6/1999 | |
| JP | 2013-227641 A | | 11/2013 | |
| JP | 2014-034706 A | | 2/2014 | |
| KR | 10-2009-0066263 A | | 6/2009 | |
| KR | 10-2014-0025463 A | | 3/2014 | |
| KR | 10-2014-0133443 A | | 11/2014 | |
| WO | 2021/019862 A1 | | 2/2021 | |

OTHER PUBLICATIONS

International Search Report dated Apr. 7, 2020, issued for PCT/JP2020/006991 and English translation thereof.
Office Action dated Jul. 28, 2021, issued for Chinese Patent Application No. 202080005424.0 and English translation thereof.
Notice of Allowance dated Nov. 1, 2021, issued for Korean Patent Application No. 10-2021-7008998 and English translation thereof.
Search Report issued in corresponding European Patent Application No. EP 20763523.6, dated Oct. 10, 2022.

* cited by examiner

*Primary Examiner* — Edna Wong
(74) *Attorney, Agent, or Firm* — Locke Lord LLP; James E. Armstrong, IV; Nicholas J. DiCeglie, Jr.

(57) ABSTRACT

The present invention provides a high-concentration tin sulfonate aqueous solution, in which a divalent tin ion ($Sn^{2+}$) concentration is 360 g/L to 420 g/L, a tetravalent tin ion ($Sn^{4+}$) concentration is 10 g/L or less, a free methanesulfonic acid concentration is 40 g/L or less, a Hazen unit color number (APHA) is 240 or less, and a turbidity is 25 FTU or less. This aqueous solution is produced such that stannous oxide powder whose temperature is adjusted to a temperature of 10° C. or lower is added to an aqueous methanesulfonic acid solution having a concentration of 60% by mass to 90% by mass when the aqueous solution circulates in a state of being maintained at the temperature of 10° C. or lower, and the stannous oxide powder is dissolved.

7 Claims, No Drawings

HIGH-CONCENTRATION TIN SULFONATE AQUEOUS SOLUTION AND METHOD FOR PRODUCING SAME

TECHNICAL FIELD

The present invention relates to a high-concentration tin sulfonate aqueous solution used for an initial make-up of an electrolytic bath or a feed of an electrolytic tin plating solution, and a method for producing the same.

Priority is claimed on Japanese Patent Application No. 2019-035186, filed on Feb. 28, 2019 and Japanese Patent Application No. 2020-018835, filed on Feb. 6, 2020, the contents of which are incorporated herein by references.

BACKGROUND ART

In the related art, as a method for producing this kind of tin methanesulfonic acid aqueous solution, (1) a method of subjecting stannous oxide powder and methanesulfonic acid to a neutralization reaction (hereinafter, referred to as a neutralization method), and (2) a method of electrolytically dissolving a tin metal in methanesulfonic acid (hereinafter, referred to as an electrolytic method) are known. A commercially available tin methanesulfonic acid aqueous solution contains tin having a concentration of 200 g/L to 300 g/L and free methanesulfonic acid (hereinafter, also simply referred to as a free acid) having a concentration of 40 g/L to 140 g/L.

In general, in a case where an insoluble electrode is used in an electrolytic tin plating bath of a tin methanesulfonic acid aqueous solution, tin ions consumed for plating are fed in the electrolytic plating bath, or a bleed-and-feed operation is performed in which a solution is drained from the electrolytic plating bath and a new tin methanesulfonic acid aqueous solution is added in order to reduce a concentration of free methanesulfonic acid generated by electrolysis.

On the other hand, as a method for preparing an electrolytic tin plating bath, a method is disclosed for chemically dissolving metal tin using a methanesulfonic acid solution having a concentration of 20 g/L to 120 g/L as an acidic solution for dissolving the tin by blowing an oxygen-containing gas into a solid-solution flow tank of metal tin particles and an acidic solution, and bringing three-phases of solid, liquid, and gas, which are metal tin particles, an electrolytic tin plating solution, and an oxygen-containing gas, respectively, into contact with one another when preparing an electric tin plating solution for chemically dissolving the metal tin in the acidic solution (Patent Document 1).

CITATION LIST

Patent Document

[Patent Document 1]
Japanese Unexamined Patent Application, First Publication No. H7-41999

SUMMARY OF INVENTION

Technical Problem

In the method disclosed in Patent Document 1, the methanesulfonic acid solution having a concentration of 20 g/L to 120 g/L is used as the acidic solution, and the oxygen-containing gas is blown into the tank to chemically dissolve the metal tin. Therefore, there was a possibility that the metal tin dissolved solution dissolved by this methanesulfonic acid solution has a dissolved oxygen level of 8 ppm or more, so that the oxidation of divalent tin ions ($Sn^{2+}$) is promoted, the concentration of tetravalent tin ions ($Sn^{4+}$) is increased, tin dioxide ($SnO_2$) is generated, and the solution is turbid. Furthermore, in a case where the above-described bleed-and-feed operation is performed, the amount of a bled solution (hereinafter, referred to as the bled solution amount) increases when a concentration of tin in the tin methanesulfonic acid aqueous solution is low or when a concentration of the free methanesulfonic acid is high, so that there was a problem in that process cost increases. Therefore, the tin methanesulfonic acid aqueous solution having a high concentration of tin and a low concentration of free methanesulfonic acid has been desired for use in an initial make-up of an electrolytic bath or a feed of the electrolytic tin plating solution.

However, in a case where the concentration of tin is increased for the above-described use, in the neutralization method of (1) described above, there was a problem in that the concentration of tetravalent tin ions ($Sn^{4+}$) is increased and tin dioxide ($SnO_2$) is generated, thereby the solution being turbid. In the electrolytic method of (2) described above, in order to increase the electrolytic dissolution efficiency of the tin metal, the concentration of free methanesulfonic acid is required to be increased, thereby reducing the solubility of tin methanesulfonic acid, and there was a possibility that tin methanesulfonic acid crystals are precipitated during storage of the solution.

An object of the present invention is to provide a high-concentration tin sulfonate aqueous solution that is transparent, does not deteriorate plating performance, requires a small amount of a feed solution in a case of the feed solution, and has excellent storage stability that crystals are not precipitated even during storage. Another object of the present invention is to provide a method for producing such a high-concentration tin sulfonate aqueous solution.

Solution to Problem

As a result of diligent studies to improve the neutralization method of (1) described above, the present inventors have focused on the fact that since the turbidity of the solution is caused by an increase in the concentration of tetravalent tin ions ($Sn^{4+}$), in a case where neutralization heat generated when stannous oxide and methanesulfonic acid are reacted is suppressed, the oxidation of divalent tin ions ($Sn^{2+}$) is suppressed, and the concentration of tetravalent tin ions ($Sn^{4+}$) is lowered, and the solution is not turbid, and the present invention has been achieved.

In a first aspect of the present invention, a high-concentration tin sulfonate aqueous solution is provided in which a divalent tin ion ($Sn^{2+}$) concentration is 360 g/L to 420 g/L, a tetravalent tin ion ($Sn^{4+}$) concentration is 10 g/L or less, a free methanesulfonic acid concentration is 40 g/L or less, a Hazen unit color number (APHA) is 240 or less, and a turbidity is 25 FTU or less.

In a second aspect of the present invention according to the first aspect, the high-concentration tin sulfonate aqueous solution contains impurities of a plurality of kinds of metals, and a total content of the plurality of kinds of metals is 30 mg/L or less in terms of metal.

In a third aspect of the present invention according to the second aspect, the high-concentration tin sulfonate aqueous solution is provided in which the plurality of kinds of metals includes sodium, potassium, lead, iron, nickel, copper, zinc, arsenic, antimony, aluminum, silver, bismuth, magnesium, calcium, titanium, chromium, manganese, cobalt, indium, tungsten, thallium, and cadmium.

In a fourth aspect of the present invention according to the second aspect, the high-concentration tin sulfonate aqueous solution is provided in which a content of each of the plurality of kinds of metals is 10 mg/L or less in terms of metal.

In a fifth aspect of the present invention according to any one of the first to fourth aspects, the high-concentration tin sulfonate aqueous solution contains chloride ions, and a content of the chloride ions is 10 mg/L or less.

In a sixth aspect of the present invention, a method for producing the high-concentration tin sulfonate aqueous solution according to any one of the first to fifth aspects is provided by subjecting stannous oxide powder and methanesulfonic acid to a neutralization reaction, the method including a step of diluting the methanesulfonic acid with pure water to obtain an aqueous methanesulfonic acid solution having a concentration of 60% by mass to 90% by mass, a step of causing the aqueous methanesulfonic acid solution to circulate in a state of being maintained at a temperature of 10° C. or lower, and a step of adding stannous oxide powder whose temperature is adjusted to a temperature of 10° C. or lower to the circulating aqueous methanesulfonic acid solution, and dissolving the stannous oxide powder.

In a seventh aspect of the present invention according to the sixth aspect, the method for producing the high-concentration tin sulfonate aqueous solution is provided in which the circulating aqueous methanesulfonic acid solution is bubbled with nitrogen gas and/or degassed with a hollow fiber membrane degassing module is provided.

In an eighth aspect of the present invention according to the sixth or seventh aspect, the method for producing the high-concentration tin sulfonate aqueous solution is provided in which the stannous oxide powder contains impurities of a plurality of kinds of metals, and a total content of the plurality of kinds of metals is 30 mg/L or less in terms of metal.

In a ninth aspect of the present invention according to the eighth aspect, the method for producing the high-concentration tin sulfonate aqueous solution is provided in which the plurality of kinds of metals includes sodium, potassium, lead, iron, nickel, copper, zinc, arsenic, antimony, aluminum, silver, bismuth, magnesium, calcium, titanium, chromium, manganese, cobalt, indium, tungsten, thallium, and cadmium.

In a tenth aspect of the present invention according to the eighth aspect, the method for producing the high-concentration tin sulfonate aqueous solution is provided in which a content of each of the plurality of kinds of metals is 10 mg/L or less in terms of metal.

In an eleventh aspect of the present invention according to any one of the sixth to tenth aspects, the method for producing the high-concentration tin sulfonate aqueous solution is provided in which the stannous oxide powder contains chloride ions, and a content of the chloride ions is 10 mg/L or less is provided.

Advantageous Effects of Invention

In the high-concentration tin sulfonate aqueous solution of the first aspect of the present invention, since the divalent tin ions ($Sn^{2+}$) have a concentration of 360 g/L to 420 g/L, the tetravalent tin ions ($Sn^{4+}$) have a concentration of 10 g/L or less, and the free methanesulfonic acid has a concentration of 40 g/L or less, the bled solution amount is small in a case where the above-described bleed-and-feed operation is performed after the initial make-up of an electrolytic bath of the electrolytic tin plating solution in this aqueous solution is performed. As a result, in a case of using a feed solution, the amount of the feed solution is small, and the process cost is not increased. In addition, since the concentration of tetravalent tin ions ($Sn^{4+}$) is as low as 10 g/L or less, the solution is not turbid, the Hazen unit color number (APHA) is 240 or less, the turbidity is 25 FTU or less, and the solution is transparent. In addition, the high-concentration tin sulfonate aqueous solution has excellent storage stability since tin methanesulfonic acid crystals are not precipitated during low-temperature storage. Furthermore, the number of particles generated in the solution due to the generation of tin dioxide ($SnO_2$) is small, and the quality of semiconductor products is improved.

In the high-concentration tin sulfonate aqueous solution according to the second aspect of the present invention, even when the high-concentration tin sulfonate aqueous solution contains impurities of the plurality of kinds of metals, the total content thereof is as small as 30 mg/L or less in terms of metal, and in the high-concentration tin sulfonate aqueous solution according to the fourth aspect, the content of each of the plurality of kinds of metals is as small as 10 mg/L or less in terms of metal. Therefore, both have the advantage that the plating performance does not deteriorate.

In the high-concentration tin sulfonate aqueous solution according to the third aspect of the present invention, even in a case where sodium or the like that adversely affects the quality of semiconductor products is used as one of the plurality of kinds of metals, since the total content of these metals is as small as 30 mg/L or less in terms of metal, the plating performance does not deteriorate, and this aqueous solution is preferable to improve the quality of semiconductor products in a case of being used for semiconductor applications.

In the high-concentration tin sulfonate aqueous solution according to the fifth aspect of the present invention, even in a case where the high-concentration tin sulfonate aqueous solution contains chloride ions, since the content thereof is as small as 10 mg/L or less, the plating performance does not deteriorate, and this aqueous solution is preferable to improve the quality of semiconductor products in a case of being used for semiconductor applications.

In the method for producing the high-concentration tin sulfonate aqueous solution according to the sixth aspect of the present invention, the methanesulfonic acid is diluted with pure water to obtain the aqueous methanesulfonic acid solution having the concentration of 60% by mass to 90% by mass, the stannous oxide powder whose temperature is adjusted to a temperature of 10° C. or lower is then added to this aqueous solution in a state of being circulated at a temperature of 10° C. or lower, and the aqueous methanesulfonic acid solution and the stannous oxide are subjected to a neutralization reaction in the low-temperature state. Therefore, neutralization heat can be suppressed. As a result, the oxidation of divalent tin ions ($Sn^{2+}$) is suppressed, the concentration of tetravalent tin ions ($Sn^{4+}$) is lowered, and the production of tin dioxide ($SnO_2$) is suppressed, so that the solution is not turbid.

In the method for producing the high-concentration tin sulfonate aqueous solution according to the seventh aspect of the present invention, the circulating aqueous methanesulfonic acid solution is bubbled with nitrogen gas and/or degassed with a hollow fiber membrane degassing module, so that the dissolved oxygen amount in the solution can be reduced. As a result, the oxidation of divalent tin ions ($Sn^{2+}$)

is further suppressed, the concentration of tetravalent tin ions (Se') is further lowered, and the production of tin dioxide ($SnO_2$) is further suppressed, so that the solution is not turbid.

In the method for producing the high-concentration tin sulfonate aqueous solution according to the eighth aspect of the present invention, the stannous oxide contains only a small amount of impurities of the plurality of kinds of metals in terms of metal equivalent of 30 mg/L or less, and in the method for producing the high-concentration tin sulfonate aqueous solution according to the tenth aspect of the present invention, since each of the plurality of kinds of metals, having only as small a content as 10 mg/L or less, is contained in terms of metal, it is possible to produce the tin sulfonate aqueous solution in which the content of the impurity metals is reduced in the obtained aqueous solution and the plating performance does not deteriorate.

In the method for producing the high-concentration tin sulfonate aqueous solution according to the ninth aspect of the present invention, even in a case where sodium and the like are used as the plurality of kinds of metals contained in the stannous oxide, which adversely affects the quality of semiconductor products, since the total content of these metals is as small as 30 mg/L or less in terms of metal, it is possible to produce the tin sulfonate aqueous solution that does not deteriorate the plating performance.

In the method for producing the high-concentration tin sulfonate aqueous solution according to the eleventh aspect of the present invention, since the stannous oxide containing only as small as 10 mg/L or less of chloride ions is used, it is possible to produce the tin sulfonate aqueous solution that does not cause the plating performance to deteriorate due to the reduction of the chloride ion concentration of the obtained aqueous solution.

DESCRIPTION OF EMBODIMENTS

Embodiments for carrying out the present invention will be described.

[High-Concentration Tin Sulfonate Aqueous Solution]

A high-concentration tin sulfonate aqueous solution of the present embodiment includes divalent tin ions ($Sn^{2+}$) having a concentration of 360 g/L to 420 g/L, tetravalent tin ions ($Sn^{4+}$) having a concentration of 10 g/L or less, and free methanesulfonic acid having a concentration of 40 g/L or less.

When the high-concentration tin sulfonate aqueous solution contains impurities of a plurality of kinds of metals, a total content of the plurality of kinds of metals is preferably 30 mg/L or less in terms of metal. A content of each of the plurality of kinds of metals is more preferably 10 mg/L or less in terms of metal. When the high-concentration tin sulfonate aqueous solution contains chloride ions, a content of the chloride ions is preferably 10 mg/L or less.

In a case where a concentration of the divalent tin ions ($Sn^{2+}$) is less than 360 g/L, there is a problem in that the bled solution amount increases in a case where the above-described bleed-and-feed operation is performed after an initial make-up of an electrolytic bath is performed on an electrolytic tin plating solution with this aqueous solution. In a case where the concentration is more than 420 g/L, stannous oxide powder is not dissolved and is precipitated during storage. A preferred range of the concentration of divalent tin ions ($Sn^{2+}$) is 380 g/L to 420 g/L, and a more preferred range is 400 g/L to 420 g/L.

In a case where a concentration of the tetravalent tin ions ($Sn^{4+}$) of this aqueous solution is more than 10 g/L, the aqueous solution is white turbid, and in a case where plating is performed with a plating solution that has been subjected to an initial make-up of an electrolytic bath with such an aqueous solution or a plating solution obtained using such an aqueous solution as a feed solution, plating performance deteriorates. A preferred range of the concentration of the tetravalent tin ions ($Sn^{4+}$) is 8 g/L or less, and a more preferred range is 5 g/L or less. In addition, in a case where a concentration of the free methanesulfonic acid is more than 40 g/L, there are problems in that the bled solution amount increases in a case where the above-described bleed-and-feed operation is performed after the initial make-up of an electrolytic bath is performed on an electrolytic tin plating solution with this aqueous solution, and tin methanesulfonic acid is precipitated during storage of this aqueous solution (specifically, during storage at the low temperature of −10° C. or lower) since solubility of the tin methanesulfonic acid decreases. A preferred range of the concentration of the free methanesulfonic acid is 0 g/L to 30 g/L, and a more preferred range is 0 g/L to 20 g/L.

In a case where the total content of impurities of the plurality of kinds of metals in this aqueous solution is more than 30 mg/L in terms of metal, and in a case where a content of chloride ions is more than 10 mg/L, the plating performance may deteriorate since metal impurities and chloride ions are involved in a plating reaction. The content of the preferred chloride ions is 8 mg/L or less.

The plurality of kinds of metals constituting the metal impurities includes sodium, potassium, lead, iron, nickel, copper, zinc, arsenic, antimony, aluminum, silver, bismuth, magnesium, calcium, titanium, chromium, manganese, cobalt, indium, tungsten, thallium, and cadmium. In a case where a large amount of such a metal is contained in the plating solution, the plating performance may deteriorate. In the high-concentration tin sulfonate aqueous solution of the present embodiment, the total content of the plurality of kinds of metals as described above is preferably 30 mg/L or less, and even more preferably 10 mg/L. Since the total content of the plurality of kinds of metals is such a small amount, the plating performance is less likely to deteriorate in a case where the aqueous solution of the present embodiment is used as a solution for an initial make-up of an electrolytic bath of the plating solution and/or as a feed solution. The content of each of the plurality of kinds of metals is more preferably 10 mg/L or less, and even more preferably 5 mg/L, as described above, in terms of metal. Since the content of each of the plurality of kinds of metals is such a small amount, the plating performance is even more less likely to deteriorate in a case where the aqueous solution of the present embodiment is used as a solution for an initial make-up of an electrolytic bath of the plating solution and/or as a feed solution.

In the high-concentration tin sulfonate aqueous solution of the present embodiment, since the concentration of the divalent tin ions ($Sn^{2+}$), the concentration of the tetravalent tin ions ($Sn^{4+}$), and the concentration of the free methanesulfonic acid are within the above ranges, a Hazen unit color number (APHA) measured in accordance with JIS K0071-1 (1998) is 240 or less. The Formazin turbidity obtained by a turbidity measurement with an integrating sphere photoelectric photometry method is 25 FTU or less.

[Method for Producing High-Concentration Tin Sulfonate Aqueous Solution]

The high-concentration tin sulfonate aqueous solution of the present embodiment includes a step of diluting methanesulfonic acid with pure water to obtain an aqueous methanesulfonic acid solution having a concentration of 60% by mass to 90% by mass, a step of causing the aqueous methanesulfonic acid solution to circulate in a state of being maintained at a temperature of 10° C. or lower, and a step of adding stannous oxide powder whose temperature is adjusted to a temperature of 10° C. or lower to the circulating aqueous methanesulfonic acid solution, and dissolving the stannous oxide powder.

The reason why a concentration of the methanesulfonic acid in the aqueous methanesulfonic acid solution is 60% by mass to 90% by mass is that in a case of exceeding this concentration range, when the tin methanesulfonic acid aqueous solution is finally prepared, the concentration of divalent tin ions ($Sn^{2+}$) is not within 360 g/L to 420 g/L. The concentration of methanesulfonic acid in the aqueous methanesulfonic acid solution is adjusted by diluting commercially available methanesulfonic acid with pure water. As the pure water, ion-exchanged water, distilled water, or the like can be used. A preferred concentration is 60% by mass to 80% by mass, and a more preferred concentration is 60% by mass to 70% by mass. Next, this aqueous methanesulfonic acid solution is placed into a neutralization tank equipped with a cooling device and caused to circulate by the cooling device in a state of being maintained at a temperature of 10° C. or lower, and preferably 0° C. or lower. As the cooling device, for example, a chiller can be used. Then, the high-concentration tin sulfonate aqueous solution can be obtained such that stannous oxide is added to the aqueous methanesulfonic acid solution being circulated at a temperature of 10° C. or lower and is dissolved. It is desirable that the stannous oxide be powder. Here, a temperature of the stannous oxide is adjusted to a temperature of 10° C. or lower. Since the stannous oxide is added at 10° C. or lower, neutralization heat generated during neutralization reaction between the aqueous methanesulfonic acid solution and stannous oxide can be suppressed. As a result, the oxidation of divalent tin ions ($Sn^{2+}$) is suppressed, the concentration of tetravalent tin ions ($Sn^{4+}$) is lowered, and the production of tin dioxide ($SnO_2$) is suppressed, so that the solution is not turbid.

It is preferable to maintain the temperature of the aqueous methanesulfonic acid solution at 10° C. or lower even during dissolution.

The stannous oxide added to the aqueous methanesulfonic acid solution reduces the content of each of the metal impurities and chloride ions in the aqueous methanesulfonic acid solution, and prevents the plating performance from being deteriorated. Therefore, in a case where impurities of the plurality of kinds of metals or chloride ions are contained, the total content of the plurality of kinds of metals is preferably 30 ppm or less and more preferably 10 ppm or less in terms of metal. In addition, the content of each of the plurality of kinds of metals is more preferably 10 ppm or less, and even more preferably 5 ppm or less in terms of metal. Furthermore, it is preferable to use stannous oxide having chloride ions of 10 ppm or less, and even more preferable to use stannous oxide having chloride ions of 5 ppm or less. The stannous oxide having such quality can be obtained by, for example, the method described in Japanese Unexamined Patent Application, First Publication No. H11-310415. In this method, stannous hydroxide is produced by subjecting a stannous salt acidic aqueous solution and a stannous salt alkaline aqueous solution to a neutralization reaction, and performing dehydration to produce stannous oxide. Specifically, the stannous oxide is produced by a neutralization step of neutralizing the stannous salt acidic aqueous solution using aqueous ammonia and ammonium bicarbonate together as the alkaline aqueous solution at a pH of 6.0 to 10.0 and a solution temperature of 50° C. or lower to cause stannous hydroxide precipitation, a step of aging and dehydrating the produced stannous hydroxide precipitation under heating to obtain stannous oxide, and a recovery step of filtering, separating, water washing, and drying the stannous oxide.

A content of metal impurities in the stannous oxide is obtained by measuring each content of sodium, potassium, lead, iron, nickel, copper, zinc, arsenic, antimony, aluminum, silver, bismuth, magnesium, calcium, titanium, chromium, manganese, cobalt, indium, tungsten, thallium, and cadmium contained in the stannous oxide by inductively coupled plasma optical emission spectrometry (ICP-OES).

The content of chloride ions in the stannous oxide is a content obtained such that the stannous oxide is dissolved in an appropriate solvent containing no chloride ions and measured by ion chromatography.

In the method for producing a high-concentration tin sulfonate aqueous solution according to the present embodiment, the circulating aqueous methanesulfonic acid solution is preferably bubbled with nitrogen gas and/or degassed with a hollow fiber membrane degassing module. Therefore, a dissolved oxygen level in the aqueous methanesulfonic acid solution is lowered, the oxidation of divalent tin ions ($Sn^{2+}$) is further suppressed, the concentration of tetravalent tin ions ($Sn^{4+}$) is further lowered, and "turbidity of the solution is not further increased. The dissolved oxygen level in the aqueous methanesulfonic acid solution is preferably 5 ppm or less, and more preferably one ppm or less.

EXAMPLES

Examples of the present invention will be described in detail with Comparative Examples.

Example 1

A tin methanesulfonic acid aqueous solution was produced by a neutralization method. First, a neutralization tank equipped with a cooling device (chiller) and connected to a nitrogen bubbling pipe and a hollow fiber membrane degassing module was prepared. On the other hand, a commercially available aqueous methanesulfonic acid solution was diluted with pure water to a concentration of 90% by mass. 1 L of the aqueous methanesulfonic acid solution whose concentration was adjusted was added into the neutralization tank, and circulated in the neutralization tank in a state of being maintained at a temperature of 10° C. by a chiller. The circulating solution was bubbled with nitrogen gas, and degassed with the hollow fiber membrane degassing module to reduce a dissolved oxygen level to one ppm or less, and a solution temperature was controlled to 10° C. by a chiller. Stannous oxide powder in which a total content of impurities of a plurality of kinds of metals whose temperature was adjusted to 10° C. was 8 ppm and a content of chloride ions was 8 ppm was gradually added thereto, the solution was uniformly stirred, and the aqueous methanesulfonic acid solution and the stannous oxide powder were subjected to a neutralization reaction. In order to achieve a target concentration of methanesulfonic acid as a free acid in the solution of 5 g/L and a target concentration of $Sn^{2+}$ of 420 g/L, the stannous oxide powder and pure water were added. Specifically, 908 g of the stannous oxide powder at 10° C. in total for the neutralization reaction and concentration adjustment was added, and 857 g of pure water in total for the dilution and concentration adjustment (5° C.) was added. As a result, a tin methanesulfonic acid aqueous solution was produced.

Example 2

The temperature of the aqueous methanesulfonic acid solution was maintained at 0° C. by the chiller and circulated in the neutralization tank, the stannous oxide powder whose temperature was adjusted to 0° C. was used, and in order to achieve a target concentration of methanesulfonic acid as a free acid in the solution of 15 g/L and a target concentration of $Sn^{2+}$ of 400 g/L, the stannous oxide powder and pure water were added. Specifically, 894 g of the stannous oxide powder at 0° C. in total for the neutralization reaction and concentration adjustment was added, and 901 g of pure water in total for the dilution and concentration adjustment (5° C.) was added. Other than this, a tin methanesulfonic acid aqueous solution was produced by the neutralization method in the same manner as in Example 1.

Example 3

The temperature of the aqueous methanesulfonic acid solution was maintained at −5° C. by the chiller and circulated in the neutralization tank, the stannous oxide powder whose temperature was adjusted to −20° C. was used, and in order to achieve a target concentration of methanesulfonic acid as a free acid in the solution of 25 g/L and a target concentration of $Sn^{2+}$ of 360 g/L, the stannous oxide powder and pure water were added. Specifically, 877 g of the stannous oxide powder at −20° C. in total for the neutralization reaction and concentration adjustment was added, and 1103 g of pure water in total for the dilution and concentration adjustment (5° C.) was added. Other than this, a tin methanesulfonic acid aqueous solution was produced by the neutralization method in the same manner as in Example 1.

Example 4

The temperature of the aqueous methanesulfonic acid solution was maintained at −5° C. by the chiller and circulated in the neutralization tank, the stannous oxide powder whose temperature was adjusted to −20° C. was used, and in order to achieve a target concentration of methanesulfonic acid as a free acid in the solution of 40 g/L and a target concentration of $Sn^{2+}$ of 400 g/L, the stannous oxide powder and pure water were added. Specifically, 861 g of the stannous oxide powder at −20° C. in total for the neutralization reaction and concentration adjustment was added, and 816 g of pure water in total for the dilution and concentration adjustment (5° C.) was added. Other than this, a tin methanesulfonic acid aqueous solution was produced by the neutralization method in the same manner as in Example 1.

Example 5

A tin methanesulfonic acid aqueous solution was produced by the neutralization method in the same manner as in Example 2, except that the dissolved oxygen level was more than 3 ppm and 5 ppm or less without degassing. In this case, the added amount of pure water was 901 g in total for the dilution and concentration adjustment (5° C.).

Example 6

A tin methanesulfonic acid aqueous solution was produced by the neutralization method in the same manner as in Example 2, except that the dissolved oxygen level was more than 1 ppm and 3 ppm or less without bubbling with nitrogen gas.

Example 7

A tin methanesulfonic acid aqueous solution was produced by the neutralization method in the same manner as in Example 2, except that the dissolved oxygen level was more than 5 ppm and 8 ppm or less without bubbling with nitrogen gas and without degassing. In this case, the added amount of pure water was 901 g in total for the dilution and concentration adjustment (5° C.).

Example 8

A tin methanesulfonic acid aqueous solution was produced by the neutralization method in the same manner as in Example 6, except that stannous oxide powder in which a total content of impurities of a plurality of kinds of metals was 8 ppm and a content of chloride ions was 20 ppm was used.

Example 9

A tin methanesulfonic acid aqueous solution was produced by the neutralization method in the same manner as in Example 6, except that stannous oxide powder in which a total content of impurities of a plurality of kinds of metals was 32 ppm and a content of chloride ions was 8 ppm was used.

Example 10

A tin methanesulfonic acid aqueous solution was produced by the neutralization method in the same manner as in Example 2, except that the concentration of the aqueous methanesulfonic acid solution was adjusted to be 70% by mass, a target concentration of methanesulfonic acid as a free acid in the solution was set to 10 g/L and a target concentration of $Sn^{2+}$ was set to 400 g/L. In this case, the added amount of the stannous oxide at 0° C. was 657 g, and the added amount of pure water was 378 g in total for the dilution and concentration adjustment (5° C.).

Example 11

A tin methanesulfonic acid aqueous solution was produced by the neutralization method in the same manner as in Example 2, except that the concentration of the aqueous methanesulfonic acid solution was adjusted to be 60% by mass, a target concentration of methanesulfonic acid as a free acid in the solution was set to 15 g/L and a target concentration of $Sn^{2+}$ was set to 400 g/L. In this case, the added amount of the stannous oxide at 0° C. was 538 g, and the added amount of pure water was 116 g in total for the dilution and concentration adjustment (5° C.).

Comparative Example 1

A tin methanesulfonic acid aqueous solution was produced by an electrolytic method. First, a metal Sn plate was prepared as an anode electrode and a Pt/Ti electrode was prepared as a cathode electrode in an electrolytic cell, and an anion exchange membrane was installed between the electrodes. 1 L of a methanesulfonic acid solution having a concentration adjusted to 90% by mass in the same manner as in Example 1 was added into an electrolytic cell, and electrolysis treatment was performed in a state where the methanesulfonic acid solution was maintained at a temperature of 10° C. In order to achieve a target concentration of methanesulfonic acid as a free acid in an electrolyte on the anode side of 30 g/L and a target concentration of $Sn^{2+}$ of 300 g/L, 382 Ah electrolysis was continued, and pure water was added to adjust the concentration. Specifically, the added amount of pure water was 1800 g in total for the dilution and concentration adjustment (5° C.). As a result, a tin methanesulfonic acid aqueous solution in the electrolytic cell was produced.

Comparative Example 2

In order to achieve a target concentration of methanesulfonic acid as a free acid in an electrolyte on the anode side of 100 g/L and a target concentration of $Sn^{2+}$ of 400 g/L, 347 Ah electrolysis was continued, and pure water was added to adjust the concentration. Otherwise, a tin methanesulfonic acid aqueous solution was produced by the electrolytic method in an electrolytic cell in the same manner as in Comparative Example 1. In this case, the added amount of pure water was 915 g in total for the dilution and concentration adjustment (5° C.).

Comparative Example 3

A tin methanesulfonic acid aqueous solution was produced by a neutralization method. The aqueous methanesulfonic acid solution was circulated in the neutralization tank in a state of being maintained at a temperature of 25° C. Stannous oxide powder maintained at 25° C. was used. In addition, bubbling with nitrogen gas and degassing were not performed, the dissolved oxygen level was set to 8 ppm or less, and in order to achieve a target concentration of methanesulfonic acid as a free acid in the solution of 30 g/L, and a target concentration of $Sn^{2+}$ of 300 g/L, the stannous oxide powder and pure water were added. Specifically, 861 g of the stannous oxide powder at 25° C. in total for the neutralization reaction and concentration adjustment was added, and 1504 g of pure water in total for the dilution and concentration adjustment (5° C.) was added. Other than this, a tin methanesulfonic acid aqueous solution was produced in the same manner as in Example 1.

Comparative Example 4

The aqueous methanesulfonic acid solution was circulated in the neutralization tank in a state of being maintained at a temperature of 25° C. The stannous oxide powder whose temperature was maintained at 25° C. and having a content of chloride ions of 12 ppm was used. In addition, bubbling with nitrogen gas and degassing were not performed, the dissolved oxygen level was set to 8 ppm or less, and in order to achieve a target concentration of methanesulfonic acid as a free acid in the solution of 20 g/L, and a target concentration of $Sn^{2+}$ of 400 g/L, the stannous oxide powder and pure water were added. Specifically, 887 g of the stannous oxide powder at 25° C. in total for the neutralization reaction and concentration adjustment was added, and 883 g of pure water in total for the dilution and concentration adjustment (5° C.) was added. Other than this, a tin methanesulfonic acid aqueous solution was produced by the neutralization method in the same manner as in Example 1.

Comparative Example 5

The aqueous methanesulfonic acid solution was circulated in the neutralization tank in a state of being maintained at a temperature of 10° C. Stannous oxide powder maintained at 25° C. was used. In addition, bubbling with nitrogen gas and degassing were not performed, the dissolved oxygen level was set to 8 ppm or less, and in order to achieve a target concentration of methanesulfonic acid as a free acid in the solution of 20 g/L, and a target concentration of $Sn^{2+}$ of 400 g/L, the stannous oxide powder and pure water were added. Specifically, 887 g of the stannous oxide powder at 25° C. in total for the neutralization reaction and concentration adjustment was added, and 883 g of pure water in total for the dilution and concentration adjustment (5° C.) was added. Other than this, a tin methanesulfonic acid aqueous solution was produced by the neutralization method in the same manner as in Example 1.

Comparative Example 6

The aqueous methanesulfonic acid solution was circulated in the neutralization tank in a state of being maintained at a temperature of 25° C. The stannous oxide powder adjusted to 10° C. was used. In addition, bubbling with nitrogen gas and degassing were not performed, the dissolved oxygen level was set to 8 ppm or less, and in order to achieve a target concentration of methanesulfonic acid as a free acid in the solution of 20 g/L, and a target concentration of $Sn^{2+}$ of 400 g/L, the stannous oxide powder and pure water were added. Specifically, 887 g of the stannous oxide powder at 10° C. in total for the neutralization reaction and concentration adjustment was added, and 883 g of pure water in total for the dilution and concentration adjustment (5° C.) was added. Other than this, a tin methanesulfonic acid aqueous solution was produced by the neutralization method in the same manner as in Example 1.

Comparative Example 7

The aqueous methanesulfonic acid solution was circulated in the neutralization tank in a state of being maintained at a temperature of 0° C. The stannous oxide powder adjusted to −10° C. was used. In addition, bubbling with nitrogen gas and degassing were performed, the dissolved oxygen level was set to 1 ppm or less, and in order to achieve a target concentration of methanesulfonic acid as a free acid in the solution of 50 g/L, and a target concentration of $Sn^{2+}$ of 420 g/L, the stannous oxide powder and pure water were added. Specifically, 852 g of the stannous oxide powder at 0° C. in total for the neutralization reaction and concentration adjustment was added, and 715 g of pure water in total for the dilution and concentration adjustment (5° C.) was added. Other than this, a tin methanesulfonic acid aqueous solution was produced by the neutralization method in the same manner as in Example 1.

Comparative Example 8

The aqueous methanesulfonic acid solution was circulated in the neutralization tank in a state of being maintained at a temperature of 0° C. The stannous oxide powder adjusted to 0° C. was used. In addition, bubbling with nitrogen gas and degassing were performed, the dissolved oxygen level was set to 1 ppm or less, and in order to achieve a target concentration of methanesulfonic acid as a free acid in the solution of 40 g/L, and a target concentration of $Sn^{2+}$ of 430 g/L, the stannous oxide powder and pure water were added. Specifically, 865 g of the stannous oxide powder at 0° C. in total for the neutralization reaction and concentration adjustment was added, and 694 g of pure water in total for the dilution and concentration adjustment (5° C.) was added. Other than this, a tin methanesulfonic acid aqueous solution was produced by the neutralization method in the same manner as in Example 1.

Each of the production methods (types, production conditions (the presence or absence of bubbling with nitride, and the presence or absence of hollow fiber membrane degassing), the concentration, temperature, and added amount of the aqueous methanesulfonic acid solution, the concentration of chloride ions, concentration of metal impurities, and added amount of the stannous oxide, and the temperature and added amount of pure water) in Examples 1 to 11 and Comparative Examples 1 to 8 described above is shown in Table.

TABLE 1

| | Production method | | | | | | | | | | | |
|---|---|---|---|---|---|---|---|---|---|---|---|---|
| | | | | Used raw material | | | | | | | | |
| | | Production condition | | Aqueous methanesulfonic acid solution | | | Stannous oxide powder | | | | Pure water | |
| | Kind | Bubbling with nitride | Hollow fiber membrane degassing | Concentration (% by mass) | Temperature (° C.) | Adding amount (L) | Chloride ion concentration (ppm) | Metal impurity concentration (ppm) | Temperature (° C.) | Adding amount (g) | Temperature (° C.) | Adding amount (g) |
| Example 1 | Neutralization method | Performed | Performed | 90 | 10 | 1 | 8 | 8 | 10 | 908 | 5 | 857 |
| Example 2 | Neutralization method | Performed | Performed | 90 | 0 | 1 | 8 | 8 | 0 | 894 | 5 | 901 |
| Example 3 | Neutralization method | Performed | Performed | 90 | −5 | 1 | 8 | 8 | −20 | 877 | 5 | 1103 |
| Example 4 | Neutralization method | Performed | Performed | 90 | −5 | 1 | 8 | 8 | −20 | 861 | 5 | 816 |
| Example 5 | Neutralization method | Performed | Not Performed | 90 | 0 | 1 | 8 | 8 | 0 | 894 | 5 | 901 |
| Example 6 | Neutralization method | Not Performed | Performed | 90 | 0 | 1 | 8 | 8 | 0 | 894 | 5 | 901 |
| Example 7 | Neutralization method | Not Performed | Not Performed | 90 | 0 | 1 | 8 | 8 | 0 | 894 | 5 | 901 |
| Example 8 | Neutralization method | Not Performed | Performed | 90 | 0 | 1 | 20 | 8 | 0 | 894 | 5 | 901 |
| Example 9 | Neutralization method | Not Performed | Performed | 90 | 0 | 1 | 8 | 32 | 0 | 894 | 5 | 901 |
| Example 10 | Neutralization method | Performed | Performed | 70 | 0 | 1 | 8 | 8 | 0 | 657 | 5 | 378 |
| Example 11 | Neutralization method | Performed | Performed | 60 | 0 | 1 | 8 | 8 | 0 | 538 | 5 | 116 |
| Comparative Example 1 | Electrolytic method | — | — | 90 | 10 | 1 | — | — | — | — | 5 | 1800 |
| Comparative Example 2 | Electrolytic method | — | — | 90 | 10 | 1 | — | — | — | — | 5 | 915 |
| Comparative Example 3 | Neutralization method | Not Performed | Not Performed | 90 | 25 | 1 | 8 | 8 | 25 | 861 | 5 | 1504 |
| Comparative Example 4 | Neutralization method | Not Performed | Not Performed | 90 | 25 | 1 | 12 | 8 | 25 | 887 | 5 | 883 |
| Comparative Example 5 | Neutralization method | Not Performed | Not Performed | 90 | 10 | 1 | 8 | 8 | 25 | 887 | 5 | 883 |
| Comparative Example 6 | Neutralization method | Not Performed | Not Performed | 90 | 25 | 1 | 8 | 8 | 10 | 887 | 5 | 883 |
| Comparative Example 7 | Neutralization method | Performed | Performed | 90 | 0 | 1 | 8 | 8 | 0 | 852 | 5 | 715 |
| Comparative Example 8 | Neutralization method | Performed | Performed | 90 | 0 | 1 | 8 | 8 | 0 | 865 | 5 | 694 |

The concentrations ($Sn^{2+}$ concentration, $Sn^{4+}$ concentration, free acid concentration, chloride ion concentration, and metal impurity concentration) of individual components in the produced tin methanesulfonic acid aqueous solution are shown in Table 2 below. A method for measuring or calculating the concentration of each component in the produced tin methanesulfonic acid aqueous solution is as follows.

(a) The $Sn^{2+}$ concentration was measured by iodine titration of the obtained tin methanesulfonic acid aqueous solution.

(b) The $Sn^{4+}$ concentration was calculated by subtracting the $Sn^{2+}$ concentration measured in (a) from the total Sn concentration. The total Sn concentration was calculated such that each of a solid Sn concentration and a dissolved Sn concentration in the obtained tin methanesulfonic acid aqueous solution was measured, and the measured concentrations were summed. Specifically, first, the obtained tin methanesulfonic acid aqueous solution was collected, filtered through a membrane filter, the weight of tin dioxide ($SnO_2$) remaining on the membrane filter was measured, and the solid Sn concentration was calculated. Subsequently, the dissolved Sn concentration in the filtered filtrate was measured using an inductively coupled plasma optical emission spectrometry (ICP-OES) device. Then, the total of the solid Sn concentration and the dissolved Sn concentration was taken as the total Sn concentration, and the $Sn^{4+}$ concentration was calculated by subtracting the $Sn^{2+}$ concentration measured in (a) from the total Sn concentration.

(c) The free methanesulfonic acid concentration was calculated by performing neutralization titration on the obtained tin methanesulfonic acid aqueous solution using an aqueous NaOH solution.

(d) The chloride ion concentration was obtained by measuring the obtained tin methanesulfonic acid aqueous solution by ion chromatography.

(e) The metal impurity concentration was measured by ICP-OES on the obtained tin methanesulfonic acid aqueous solution. Metals subjected to measurement were sodium, potassium, lead, iron, nickel, copper, zinc, arsenic, antimony, aluminum, silver, bismuth, magnesium, calcium, titanium, chromium, manganese, cobalt, indium, tungsten, thallium, and cadmium. The values shown in Table 2 are the total contents of these metals.

TABLE 2

| | Each concentration of tin methanesulfonic acid aqueous solution | | | | | Evaluation | | | |
|---|---|---|---|---|---|---|---|---|---|
| | (a) $Sn^{2+}$ concentration (g/L) | (b) $Sn^{4+}$ concentration (g/L) | (c) Free acid concentration (g/L) | (d) Chloride ion concentration (mg/L) | (e) Metal impurity concentration (mg/L) | (1) APHA | (2) Turbidity (FTU) | (3) Presence or absence of precipitation during low-temperature storage | (4) Percentage of amount of tin solution to be fed (%) |
| Example 1 | 420 | 4 | 5 | 7 | 7 | 60 | 10 | None precipitation | 65 |
| Example 2 | 400 | 2 | 15 | 7 | 7 | 30 | 6 | None precipitation | 70 |
| Example 3 | 360 | 0.5 | 25 | 7 | 7 | 15 | 2 | None precipitation | 79 |
| Example 4 | 400 | 0.5 | 40 | 7 | 7 | 15 | 2 | None precipitation | 74 |
| Example 5 | 400 | 6 | 15 | 7 | 7 | 150 | 10 | None precipitation | 70 |
| Example 6 | 400 | 4 | 15 | 7 | 7 | 130 | 14 | None precipitation | 70 |
| Example 7 | 400 | 8 | 15 | 7 | 7 | 240 | 25 | None precipitation | 70 |
| Example 8 | 400 | 4 | 15 | 18 | 7 | 130 | 15 | None precipitation | 70 |
| Example 9 | 400 | 4 | 15 | 7 | 29 | 130 | 14 | None precipitation | 70 |
| Example 10 | 400 | 1 | 10 | 5 | 5 | 20 | 5 | None precipitation | 68 |
| Example 11 | 400 | 1 | 10 | 4 | 4 | 20 | 5 | None precipitation | 68 |
| Comparative Example 1 | 300 | 4 | 30 | 2 | 8 | 90 | 12 | None precipitation | 100 |
| Comparative Example 2 | 400 | 7 | 100 | 3 | 12 | 240 | 24 | Precipitation | 88 |
| Comparative Example 3 | 300 | 16 | 30 | 7 | 7 | 420 | 58 | None precipitation | 100 |
| Comparative Example 4 | 400 | 24 | 20 | 11 | 7 | 900 | 110 | None precipitation | — |
| Comparative Example 5 | 400 | 15 | 20 | 7 | 7 | 390 | 54 | None precipitation | 71 |
| Comparative Example 6 | 400 | 14 | 20 | 7 | 7 | 330 | 52 | None precipitation | 71 |
| Comparative Example 7 | 420 | 1 | 50 | 7 | 7 | 60 | 6 | Precipitation | 72 |
| Comparative Example 8 | 430 | 1 | 40 | 7 | 7 | 50 | 4 | Precipitation | 69 |

In order to evaluate each of the production methods (types, production conditions, and the like) of Examples 1 to 11 and Comparative Examples 1 to 8 described above and the produced tin methanesulfonic acid aqueous solution (hereinafter, may be simply referred to as a tin solution), (1) Hazen unit color number (APHA) measured in accordance with JIS K0071-1 (1998), (2) Formazin turbidity obtained by turbidity measurement using an integrating sphere photoelectric photometry method, and (3) Precipitation status of this aqueous solution at low temperature are shown in Table 2 described above, and (4) Ratio of amount of tin solution to be fed when this aqueous solution was fed to the electrolytic tin plating solution is shown in Table 2 described above and Table 3 described below. These evaluation items were evaluated by the following methods.

(1) Hazen Unit Color Number (APHA)

The produced tin methanesulfonic acid aqueous solution was separated into a glass cell, and APHA was measured from color measurement using TZ6000 manufactured by NIPPON DENSHOKU INDUSTRIES Co., Ltd.

(2) Formazin Turbidity (Total Light Beam Transmittance)

The produced tin methanesulfonic acid aqueous solution was separated into a glass cell, and turbidity was measured by a method conforming to JIS K 0101-1998 using PT-2000 manufactured by Mitsubishi Chemical Analytech Co., Ltd. and a Formazin standard solution.

(3) Precipitation Status of Solution During Low-Temperature Storage

Tin methanesulfonic acid crystals were precipitated on a bottom of the container when the tin methanesulfonic acid aqueous solution produced in a refrigerator set at −10° C. was stored in a glass container having a capacity of 1 liter for 24 hours, and the presence or absence of the crystals was visually confirmed.

(4) Percentage of Amount Used when Tin Methanesulfonic Acid Aqueous Solution was Fed with the Electrolytic Tin Plating Solution The solution amount of the tin methanesulfonic acid aqueous solution used for feeding the electrolytic tin plating solution, that is, a percentage of the tin solution amount to be fed was calculated by the following method.

First, the following pure tin plating solution was subjected to an initial make-up of an electrolytic bath. An insoluble Pt/Ti plate as an anode and a silicon wafer having a surface on which a Cu conductive layer formed by a sputtering method as a cathode were each placed in the plating solution, and electrolyzed to 10 Ah/L at a bath temperature of 30° C. and a cathode current density of 5 ASD. The plating solution amount decreased due to electrolysis and volatilization of water by electrolysis so that the plating solution was normally caused to circulate in the plating equipment. Therefore, pure water was automatically fed through a solution level sensor during electrolysis to maintain a constant bath volume. A commercially available additive for a pure tin plating solution was used as an additive.

(Composition of Sn Plating Solution During Initial Make-Up of Electrolytic Bath)

$Sn^{2+}$ concentration: 100 g/L

Free acid (methanesulfonic acid) concentration: 50 g/L

Additive concentration: 50 mL/L

Bath volume: 100 L (Composition of Sn Plating Solution after Electrolysis)

A composition of an Sn plating solution after electrolysis was as follows.

$Sn^{2+}$ concentration: 78 g/L

Free acid (methanesulfonic acid) concentration: 82 g/L

Additive concentration: 50 mL/L

Bath volume: 100 L

Next, in order to recover the plating solution after electrolysis to an initial concentration, a bleed-and-feed operation was performed using the tin sulfonate aqueous solution of Comparative Example 1. The bleed-and-feed operation is an operation of bleeding a part of the plating solution after electrolysis and feeding the feed solution in order to maintain a constant amount of the solution in the device. The amount of solution required at that time was as follows. The amounts of these solutions are also shown in Table 3.

Bled solution amount: 47 L

Tin Solution of Comparative Example 1: 19.6 L

Additive: 2.4 L

Pure water: 25.0 L

A more specific description is as follows. 47 L of the plating solution was bled from 100 L of the plating solution after electrolytic plating. After the bleeding, 19.6 L of the tin solution of Comparative Example 1, 2.4 L of the additive, and 25 L of pure water were added to the 53 L of the plating solution remaining in the device, and the plating solution amount was recovered to the original amount of 100 L.

The amount of tin solution to be fed when the tin sulfonate aqueous solution of Comparative Example 1 was fed to the electrolytic tin plating solution was a normal feed amount in plating of the related art. In order to evaluate how much the feed amount in other Examples and Comparative Examples decreased as compared with the related art, a percentage (%) of the feed amount in other Examples to the feed amount in Comparative Examples 1: 19.6 L was calculated. The results are shown in Table 2 described above and Table 3 described below. It was determined that a cost reduction effect was obtained in a case where the concentration at which the amount of used tin solution was reduced by 20% or more, that is, in a case where the amount of tin solution to be fed was less than 80%. The bled solution amount and the feed amount (tin solution, additive, and pure water) of Examples 1 to 11 and Comparative Examples 2 to 8 are shown in Table 3.

TABLE 3

| | | Feed amount | | | |
|---|---|---|---|---|---|
| | Bleed amount (L) | Tin solution (L) | Additive (L) | Pure water (L) | Percentage of amount of tin solution to be fed (%) |
| Example 1 | 40 | 12.7 | 2.0 | 25.3 | 65 |
| Example 2 | 42 | 13.7 | 2.1 | 26.2 | 70 |
| Example 3 | 44 | 15.6 | 2.2 | 26.2 | 79 |
| Example 4 | 46 | 14.5 | 2.3 | 29.2 | 74 |
| Example 5 | 42 | 13.7 | 2.1 | 26.2 | 70 |
| Exainple 6 | 42 | 13.7 | 2.1 | 26.2 | 70 |
| Exainple 7 | 42 | 13.7 | 2.1 | 26.2 | 70 |
| Example 8 | 42 | 13.7 | 2.1 | 26.2 | 70 |
| Example 9 | 42 | 13.7 | 2.1 | 26.2 | 70 |
| Example 10 | 41 | 13.4 | 2.1 | 25.5 | 68 |
| Example 11 | 41 | 13.4 | 2.1 | 25.5 | 68 |
| Comparative Example 1 | 47 | 19.6 | 2.4 | 25.0 | 100 |
| Comparative Example 2 | 60 | 17.2 | 3.0 | 39.8 | 88 |
| Comparative Example 3 | 47 | 19.6 | 2.4 | 25.0 | 100 |
| Comparative Example 4 | 43 | 13.9 | 2.2 | 26.9 | — |
| Comparative Example 5 | 43 | 13.9 | 2.2 | 26.9 | 71 |
| Comparative Example 6 | 43 | 13.9 | 2.2 | 26.9 | 71 |
| Comparative Example 7 | 48 | 14.2 | 2.4 | 31.4 | 72 |
| Comparative Example 8 | 46 | 13.5 | 2.3 | 30.2 | 69 |

As is clear from Table 2 and Table 3 described above, in Comparative Example 1, APHA and turbidity were low and transparent, and the precipitation of tin methanesulfonic acid crystals during low-temperature storage was "None precipitation". However, since the $Sn^{2+}$ concentration was as low as 300 g/L, the percentage of the amount of tin solution to be fed was 100%, and there was no effect of reducing the amount of tin solution to be fed.

In Comparative Example 2, APHA and turbidity were low, and the solution was transparent. However, since the free acid concentration was as high as 100 g/L, the precipitation of tin methanesulfonic acid crystals was observed during low-temperature storage, the bled solution amount was large, and the percentage of the tin sulfonate aqueous solution to be fed was 88%, so that the effect of reducing the amount of tin solution to be fed was not so great.

In Comparative Example 3, the precipitation of tin methanesulfonic acid crystals during low-temperature storage was "None precipitation", but the temperature of methanesulfonic acid was as high as 25° C. during the production of the tin sulfonate aqueous solution, and the temperature of stannous oxide was also as high as 25° C. Therefore, the $Sn^{4+}$ concentration was as high as 16 g/L, the APHA and turbidity were relatively high, and turbidity was generated. In addition, since the $Sn^{2+}$ concentration was as low as 300 g/L, the percentage of the amount of tin solution to be fed was 100%, and there was no effect of reducing the amount of tin solution to be fed.

In Comparative Example 4, the precipitation of tin methanesulfonic acid crystals during low-temperature storage was "None precipitation", but the temperature of methanesulfonic acid was as high as 25° C. during the production of the tin sulfonate aqueous solution, and the temperature of stannous oxide was also as high as 25° C. Therefore, the $Sn^{4+}$ concentration was as high as 24 g/L, the APHA and turbidity were high, the solution was white turbid, and the solution was not fed.

In Comparative Example 5, the precipitation of tin methanesulfonic acid crystals during low-temperature storage was "None precipitation", and the percentage of the amount of tin solution to be fed was 71%, which exhibited the effect of reducing the amount of tin solution to be fed. However, during the production of the tin sulfonate aqueous solution, the temperature of stannous oxide was as high as 25° C. Therefore, the $Sn^{4+}$ concentration was as high as 15 g/L, the APHA and turbidity were relatively high, and turbidity was generated in the solution.

In Comparative Example 6, the precipitation of tin methanesulfonic acid crystals during low-temperature storage was "None precipitation", and the percentage of the amount of tin solution to be fed was 71%, which exhibited the effect of reducing the amount of tin solution to be fed. However, during the production of the tin sulfonate aqueous solution, the temperature of methanesulfonic acid was as high as 25° C. Therefore, the $Sn^{4+}$ concentration was as high as 14 g/L, the APHA and turbidity were relatively high, and turbidity was generated in the solution.

In Comparative Example 7, the APHA and turbidity were low, the solution was transparent, the percentage of the amount of tin solution to be fed was 72%, and there was the effect of reducing the amount of tin solution to be fed. However, since the free acid concentration of the tin solution was as high as 50 g/L, the solubility of tin methanesulfonic acid decreased, and the precipitation of tin methanesulfonic acid crystals was observed during low-temperature storage.

In Comparative Example 8, the APHA and turbidity were low, the solution was transparent, the percentage of the amount of tin solution to be fed was 69%, and there was the effect of reducing the amount of tin solution to be fed. However, since the $Sn^{2+}$ concentration of the tin solution was as high as 430 g/L, the precipitation of tin methanesulfonic acid crystals was observed during low-temperature storage.

On the other hand, in Examples 1 to 11, the $Sn^{2+}$ concentration was 360 to 420 g/L, the $Sn^{4+}$ concentration was 10 g/L or less, and the concentration of the free methanesulfonic acid was 40 g/L or less. Therefore, as compared with the cases of Comparative Examples 1 to 8, the amount of tin solution to be fed could be reduced by 20% or more. In addition, the APHA and turbidity of the tin solution were low, the solution was transparent, and the precipitation of tin methanesulfonic acid crystals was not observed during low-temperature storage.

As shown in Table 2, in Example 8, the reason why the chloride ion concentration in the tin methanesulfonic acid aqueous solution was 18 mg/L, which was higher than those in Examples 1 to 7 and 9 to 11, is that the chloride ion concentration of a raw material in the stannous oxide was 20 ppm (Table 1), which was higher than those in Examples 1 to 7 and 9 to 11. As shown in Table 2, in Example 9, the reason why the concentration of metal impurities in the tin methanesulfonic acid aqueous solution was 29 mg/L, which was higher than those in Examples 1 to 8 and 10 to 11, is that the concentration of metal impurities in the stannous oxide of a raw material was 32 ppm (Table 1), which was higher than those in Examples 1 to 8 and 10 and 11. Furthermore, as shown in Table 2, in Comparative Example 4, the reason why the chloride ion concentration in the tin methanesulfonic acid aqueous solution was 11 mg/L, which was higher than those in Comparative Examples 3 and 5 to 8, is that the chloride ion concentration of a raw material in the stannous oxide was 12 ppm (Table 1), which was higher than those in Comparative Examples 3 and 5 to 8.

As shown in Table 2, the reason why each APHA in Examples 6, 8, and 9 was 130, which was higher than those in Examples 1 to 4, 10, and 11, is that the hollow fiber membrane degassing was performed as shown in Table 1, but the bubbling with nitride was not performed. In addition, as shown in Table 2, the reason why the APHA in Example 5 was 150, which was higher than those in Examples 1 to 4, 10, and 11, is that the bubbling with nitride was performed as shown in Table 1, but the hollow fiber membrane degassing was not performed. Furthermore, as shown in Table 2, the reason why the APHA was 240 and the turbidity was 25 in Example 7, which were higher than those in Examples 1 to 4, 10, and 11, is that neither the bubbling with nitride nor the hollow fiber membrane degassing were performed as shown in Table 1.

INDUSTRIAL APPLICABILITY

The high-concentration tin sulfonate aqueous solution of the present invention can be used for the initial make-up of an electrolytic bath or feed of an electrolytic tin plating solution.

What is claimed is:

1. A method for producing a high-concentration tin sulfonate aqueous solution the method comprising:

a step of diluting methanesulfonic acid with pure water to obtain an aqueous methanesulfonic acid solution having a concentration of 60% by mass to 90% by mass;

a step of causing the aqueous methanesulfonic acid solution to circulate in a state of being maintained at a temperature of 10° C. or lower;

a step of subjecting the aqueous methanesulfonic acid solution and a first stannous oxide powder to a neutralization reaction by adding the first stannous oxide powder whose temperature is adjusted to a temperature of 10° C. or lower to the circulating aqueous methanesulfonic acid solution and dissolving the first stannous oxide powder; and a step of adding a second stannous oxide powder and pure water to adjust a concentration of $Sn^{2+}$ in a range of 360 g/L to 420 g/L.

2. The method for producing a high-concentration tin sulfonate aqueous solution according to claim 1, wherein the circulating aqueous methanesulfonic acid solution is bubbled with nitrogen gas and/or degassed with a hollow fiber membrane degassing module.

3. The method for producing a high-concentration tin sulfonate aqueous solution according to claim 1, wherein the stannous oxide powder contains impurities of a plurality of metals, and a total content of the plurality of kinds of metals is 30 mg/L or less in terms of metal.

4. The method for producing a high-concentration tin sulfonate aqueous solution according to claim 3, wherein the plurality of metals includes sodium, potassium, lead, iron, nickel, copper, zinc, arsenic, antimony, aluminum, silver, bismuth, magnesium, calcium, titanium, chromium, manganese, cobalt, indium, tungsten, thallium, and cadmium.

5. The method for producing a high-concentration tin sulfonate aqueous solution according to claim 3, wherein a content of each of the plurality of metals is 10 mg/L or less in terms of metal.

6. The method for producing a high-concentration tin sulfonate aqueous solution according to claim 1, wherein the first stannous oxide powder contains chloride ions, and a content of the chloride ions is 10 mg/L or less.

7. The method for producing a high-concentration tin sulfonate aqueous solution according to claim 1, wherein the high-concentration tin sulfonate aqueous solution contains:

a divalent tin ion ($Sn^{2+}$) concentration is 360 g/L to 420 g/L, a tetravalent tin ion ($Sn^{4+}$) concentration is 10 g/L or less, a free methanesulfonic acid concentration is 40 g/L or less, a Hazen unit color number (APHA) is 240 or less, and a turbidity is 25 FTU or less.

* * * * *